US010092939B2

(12) United States Patent
Sakane et al.

(10) Patent No.: US 10,092,939 B2
(45) Date of Patent: Oct. 9, 2018

(54) SPINNING FORMING DEVICE

(71) Applicant: KAWASAKI JUKOGYO KABUSHIKI KAISHA, Kobe-shi, Hyogo (JP)

(72) Inventors: Yuto Sakane, Kobe (JP); Yoshihide Imamura, Kobe (JP); Kohei Mikami, Akashi (JP); Hayato Iwasaki, Kobe (JP); Hiroshi Kitano, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 0 days.

(21) Appl. No.: 15/108,121

(22) PCT Filed: Dec. 16, 2014

(86) PCT No.: PCT/JP2014/006279

§ 371 (c)(1),
(2) Date: Jun. 24, 2016

(87) PCT Pub. No.: WO2015/098044

PCT Pub. Date: Jul. 2, 2015

(65) Prior Publication Data

US 2016/0325335 A1 Nov. 10, 2016

(30) Foreign Application Priority Data

Dec. 24, 2013 (JP) ..... 2013-265535

(51) Int. Cl.
*B21D 22/18* (2006.01)
*B21D 22/14* (2006.01)
(Continued)

(52) U.S. Cl.
CPC ..... *B21D 22/18* (2013.01); *B21D 22/14* (2013.01); *B21D 37/16* (2013.01); *H05B 6/102* (2013.01); *H05B 6/42* (2013.01)

(58) Field of Classification Search
CPC ..... B21D 22/14; B21D 22/16; B21D 22/18
See application file for complete search history.

(56) References Cited

U.S. PATENT DOCUMENTS 3,815,395 A 6/1974 Sass
5,687,599 A * 11/1997 Donaldson ..... B21D 26/14 72/56

FOREIGN PATENT DOCUMENTS

JP S48-41965 A 6/1973
JP 2-79594 U 6/1990
(Continued)

OTHER PUBLICATIONS

Mar. 10, 2015 International Search Report issued in International Patent Application No. PCT/JP2014/006279.
(Continued)

*Primary Examiner* — Debra Sullivan
(74) *Attorney, Agent, or Firm* — Oliff PLC

(57) ABSTRACT

A spinning forming device according to one aspect, a receiving jig supporting a central portion of a plate to be formed is attached to a rotating shaft, and a transform target portion of the plate is pressed by a processing tool and locally heated by a heater that performs induction heating. The heater includes an electric conducting pipe in which a cooling liquid flows. The electric conducting pipe includes: a coil portion extending in a circumferential direction of the rotating shaft and having a doubled circular-arc shape facing the plate; and a pair of lead portions extending from the coil portion outward in a radial direction of the rotating shaft. Each of the pair of lead portions is retreated father away from the plate than the coil portion at its end portion adjacent to the coil portion.

9 Claims, 12 Drawing Sheets

(51) Int. Cl.

| | |
|---|---|
| ***B21D 37/16*** | (2006.01) |
| ***H05B 6/10*** | (2006.01) |
| ***H05B 6/42*** | (2006.01) |

(56) References Cited

FOREIGN PATENT DOCUMENTS

| | | | | |
|---|---|---|---|---|
| JP | H02-79594 | U | | 6/1990 |
| JP | 2006-294396 | A | | 10/2006 |
| JP | 2008-276974 | A | | 11/2008 |
| JP | 2011-218427 | A | | 11/2011 |
| JP | 2013161767 | A | * | 8/2013 |
| WO | 2014/024384 | A1 | | 2/2014 |
| WO | 2014/034140 | A1 | | 3/2014 |
| WO | 2014/097551 | A1 | | 6/2014 |

OTHER PUBLICATIONS

Mar. 10, 2015 Written Opinion issued in International Patent Application No. PCT/JP2014/006279.

* cited by examiner

SPINNING FORMING DEVICE

TECHNICAL FIELD

The present invention relates to a spinning forming device for forming a plate in a desired shape while rotating the plate.

BACKGROUND ART

Conventionally known is a spinning forming device designed to transform a plate by pressing a processing tool against the plate while rotating the plate. The spinning forming device normally includes a mandrel (shaping die) attached to a rotating shaft and performs forming in such a manner that the plate is pressed against the mandrel by the processing tool.

In recent years, proposed is a spinning forming device designed to perform spinning forming while locally heating the plate. For example, as a spinning forming device for a titanium alloy, PTL 1 discloses a spinning forming device configured such that a portion of the plate which is pressed against the mandrel by a spatula (processing tool) is heated by high frequency induction heating.

CITATION LIST

Patent Literature

PTL 1: Japanese Laid-Open Patent Application Publication No. 2011-218427

SUMMARY OF INVENTION

Technical Problem

The inventors of the present invention have found that by locally heating the plate by induction heating, the plate can be transformed into a final shape in the atmosphere without using the mandrel. From this point of view, in an application (Japanese Patent Application No. 2012-178269) preceding the present application, the applicant of the present application has proposed a spinning forming device using, instead of the mandrel, a receiving jig supporting a central portion of the plate. According to this spinning forming device, at a position away from the receiving jig, a transform target portion of the plate is heated by a heater and is pressed by the processing tool.

Further, as a heater suitable for the spinning forming device using the receiving jig, the inventors of the present invention have devised a heater including a coil portion having a doubled circular-arc shape. The coil portion is a part of an electric conducting pipe in which a cooling liquid flows. A large current can flow through the electric conducting pipe by circulation of the cooling liquid flowing through the electric conducting pipe. In such a spinning forming device, the plate and the heater need to be maintained in a noncontact state.

An object of the present invention is to provide a spinning forming device capable of preventing a plate and a heater from contacting each other.

Solution to Problem

To solve the above problem, one aspect of the present invention provides a spinning forming device including: a receiving jig supporting a central portion of a plate to be formed; a rotating shaft to which the receiving jig is attached; a processing tool that presses a transform target portion of the plate to transform the plate; and a heater that locally heats the transform target portion by induction heating, wherein: the heater includes an electric conducting pipe in which a cooling liquid flows; the electric conducting pipe includes a coil portion extending in a circumferential direction of the rotating shaft and having a doubled circular-arc shape facing the plate and a pair of lead portions extending from the coil portion outward in a radial direction of the rotating shaft; and each of the pair of lead portions is retreated farther away from the plate than the coil portion at its end portion adjacent to the coil portion.

Another aspect of the present invention provides a spinning forming device including: a receiving jig supporting a central portion of a plate to be formed; a rotating shaft to which the receiving jig is attached; a processing tool that presses a transform target portion of the plate to transform the plate; and a front-side heater that locally heats the transform target portion by induction heating and is disposed at a same side as the processing tool relative to the plate, wherein: the front-side heater includes an electric conducting pipe in which a cooling liquid flows, the electric conducting pipe including a coil portion, the coil portion extending in a circumferential direction of the rotating shaft and having a doubled circular-arc shape facing the plate, a first core covering an inner circular-arc portion of the coil portion from an opposite side of the plate, and a second core covering an outer circular-arc portion of the coil portion from the opposite side of the plate; and an inner wall portion of the first core has a shape that tapers toward a tip end of the inner wall portion, the inner wall portion being located at a radially inner side of the inner circular-arc portion, or at least the part of the inner wall portion of the first core is thinner than an outer wall portion of the first core, the outer wall portion being located at a radially outer side of the inner circular-arc portion.

Yet another aspect of the present invention provides a spinning forming device including: a receiving jig supporting a central portion of a plate to be formed; a rotating shaft to which the receiving jig is attached; a processing tool that presses a transform target portion of the plate to transform the plate; a front-side heater that locally heats the transform target portion by induction heating and is disposed at a same side as the processing tool relative to the plate; a rear-side heater that locally heats the transform target portion by the induction heating and is disposed at an opposite side of the processing tool across the plate; an axial direction movement mechanism that moves the front-side heater and the rear-side heater in an axial direction of the rotating shaft; a first radial direction movement mechanism that moves the rear-side heater in a radial direction of the rotating shaft; and a second radial direction movement mechanism that moves the front-side heater in the radial direction of the rotating shaft at a speed higher than a speed at which the rear-side heater moves, wherein each of the front-side heater and the rear-side heater includes an electric conducting pipe in which a cooling liquid flows, the electric conducting pipe including a coil portion, the coil portion extending in a circumferential direction of the rotating shaft and having a doubled circular-arc shape facing the plate, a first core covering an inner circular-arc portion of the coil portion from an opposite side of the plate, and a second core covering an outer circular-arc portion of the coil portion from the opposite side of the plate.

Advantageous Effects of Invention

The present invention can prevent the plate and the heater from contacting each other.

DESCRIPTION OF EMBODIMENTS

Hereinafter, Embodiments 1 to 3 will be explained as embodiments of the present invention.

One example of how a plate and a heater contact each other is as follows. For example, a heater that heats a transform target portion of a plate may be configured to include a pair of lead portions extending from a coil portion outward in a radial direction of a rotating shaft.

Typically, a conventional spinning forming device using a mandrel does not include a heater. Further, since the transform target portion of the plate is pressed against the mandrel by a processing tool, it is unnecessary to pay attention to deformation of a peripheral edge portion of the plate. On the other hand, when using a receiving jig against which the plate is not pressed by the processing tool, in other words, when using a receiving jig not including a forming surface, the plate is processed with the transform target portion floating in the air. Therefore, when the receiving jig is used in a spinning forming device including a heater, the deformation of the peripheral edge portion of the plate is a problem. To be specific, if the peripheral edge portion of the plate deforms, the plate may contact the pair of lead portions.

A main object of Embodiment 1 is to prevent the plate and the lead portions from contacting each other.

Another example of how the plate and the heater contact each other is as follows. In the spinning forming device, the processing tool presses the transform target portion of the plate in an axial direction of the rotating shaft while being moved outward in the radial direction of the rotating shaft. To be specific, as the transform target portion travels outward in the radial direction, a diameter of a conical portion (so-called immediately-after-forming portion) shaped immediately inside the transform target portion gradually increases. On the other hand, a radius of the coil portion of the heater that heats the transform target portion is typically constant.

Generally, the heater includes a core that covers the coil portion from an opposite side of the plate and collects magnetic flux. Therefore, when the heater is disposed at the same side as the processing tool, the immediately-after-forming portion of the plate may contact the core of the heater.

A main object of each of Embodiments 2 and 3 is to prevent the immediately-after-forming portion of the plate and the core from contacting each other.

Hereinafter, Embodiments 1 to 3 will be explained in detail.

Embodiment 1

Figure 1:
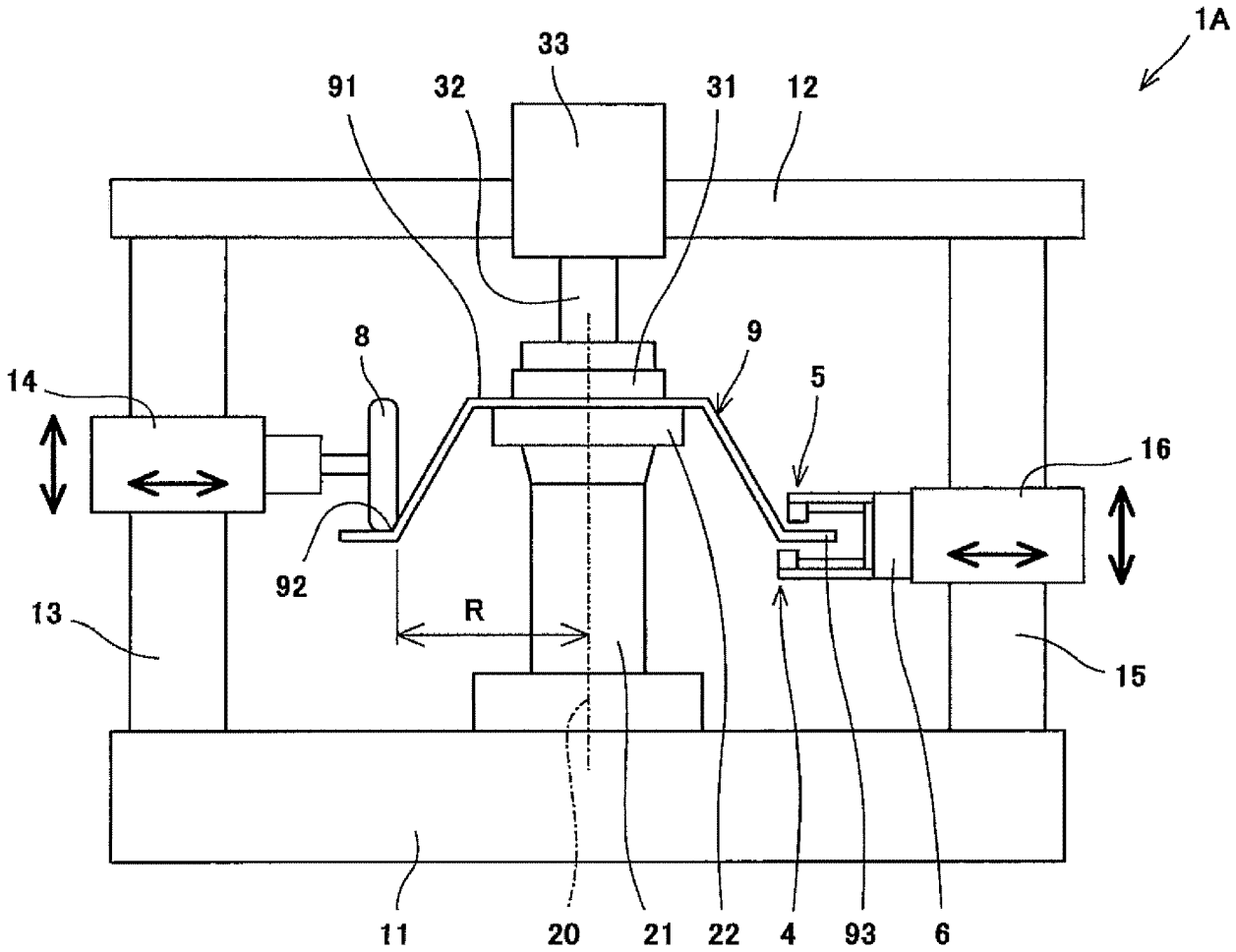
FIG. 1 is a schematic configuration diagram showing a spinning forming device according to Embodiment 1 of the present invention.

FIG. 1 shows a spinning forming device 1A according to Embodiment 1 of the present invention. The spinning forming device 1A includes a rotating shaft 21, a receiving jig 22 attached to the rotating shaft 21, and a fixing jig 31. The receiving jig 22 supports a central portion 91 of a plate 9 to be formed, and the fixing jig 31 sandwiches the plate 9 together with the receiving jig 22. The spinning forming device 1A further includes: a front-side heater 5 and a rear-side heater 4 each of which locally heats a transform target portion 92 of the plate 9 by induction heating, the transform target portion 92 being located away from a center axis 20 of the rotating shaft 21 by a predetermined distance R; and a processing tool 8 that presses the transform target portion 92 to transform the plate 9.

Figure 16:
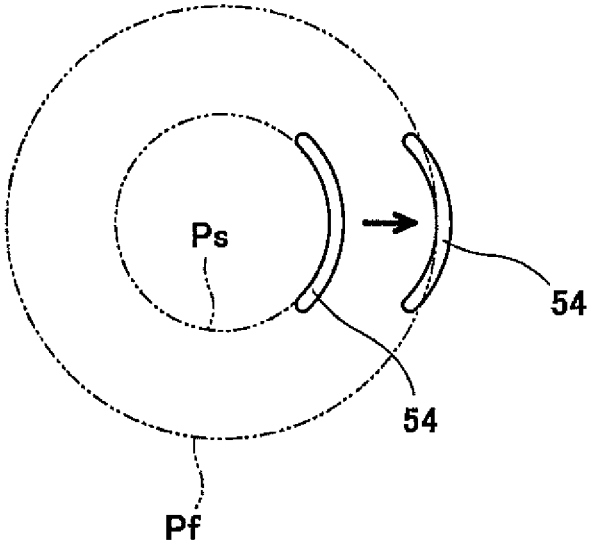
FIG. 16 is a diagram showing a positional relationship among a forming start position, a forming finish position, and a coil portion of the front-side heater.

For example, as shown in FIG. 16, the transform target portion 92 travels from a forming start position Ps to a forming finish position Pf such that a predetermined distance R gradually increases.

Referring back to FIG. 1, an axial direction of the rotating shaft 21 (i.e., a direction in which the center axis 20 extends) is a vertical direction in the present embodiment. However, the axial direction of the rotating shaft 21 may be a horizontal direction or an oblique direction. A lower portion of the rotating shaft 21 is supported by a base 11. A motor (not shown) that rotates the rotating shaft 21 is disposed in the base 11. An upper surface of the rotating shaft 21 is flat, and the receiving jig 22 is fixed to the upper surface of the rotating shaft 21.

The plate 9 is, for example, a flat circular plate. However, the shape of the plate 9 may be a polygonal shape or an oval shape. The plate 9 is not necessarily flat over the entirety. For example, the central portion 91 of the plate 9 may be thicker than a peripheral edge portion 93 of the plate 9, or the entire plate 9 or a part of the plate 9 may be processed in advance to have a tapered shape. A material of the plate 9 is not especially limited and is, for example, a titanium alloy.

The receiving jig 22 has a size within a circle defined by the forming start position Ps of the plate 9. For example, in a case where the receiving jig 22 has a disc shape, a diameter of the receiving jig 22 is equal to or smaller than a diameter of the circle defined by the forming start position Ps of the plate 9. Unlike conventional mandrels, the plate 9 is not transformed by being pressed against a radially outer side surface of the receiving jig 22.

The fixing jig 31 is attached to a pressurizing rod 32. The pressurizing rod 32 is driven by a driving portion 33 in an upward/downward direction to press the plate 9 against the receiving jig 22 via the fixing jig 31. For example, the pressurizing rod 32 and the driving portion 33 constitute a hydraulic cylinder. The driving portion 33 is fixed to a frame 12 disposed above the rotating shaft 21, and a bearing rotatably supporting the pressurizing rod 32 is incorporated in the driving portion 33.

It should be noted that the pressurizing rod 32 and the driving portion 33 are not necessarily required. For example, the fixing jig 31 may be fixed to the receiving jig 22 together with the plate 9 by fastening members, such as bolts or clamps. Or, the fixing jig 31 may be omitted, and the plate 9 may be directly fixed to the receiving jig 22 by, for example, bolts.

In the present embodiment, the processing tool 8 that presses the transform target portion 92 of the plate 9 is disposed above the plate 9, and the plate 9 is processed by the processing tool 8 in a downwardly opening shape that accommodates the receiving jig 22. To be specific, an upper surface of the plate 9 is a front surface, and a lower surface of the plate 9 is a rear surface. However, the processing tool 8 may be disposed under the plate 9, and the plate 9 may be processed by the processing tool 8 in an upwardly opening shape that accommodates the fixing jig 31. To be specific, the lower surface of the plate 9 may be the front surface, and the upper surface of the plate 9 may be the rear surface.

The processing tool 8 is moved by a radial direction movement mechanism 14 in the radial direction of the rotating shaft 21 and is also moved by an axial direction movement mechanism 13 through the radial direction movement mechanism 14 in the axial direction of the rotating shaft 21. The axial direction movement mechanism 13 extends so as to couple the base 11 and the frame 12. In the present embodiment, used as the processing tool 8 is a roller that follows the rotation of the plate 9 to rotate. However, the processing tool 8 is not limited to the roller and may be, for example, a spatula.

The front-side heater 5 is disposed at the same side as the processing tool 8 relative to the plate 9, and the rear-side heater 4 is disposed at an opposite side of the processing tool 8 across the plate 9. In the present embodiment, the front-side heater 5 and the rear-side heater 4 are coupled to a common heat station 6. The front-side heater 5 and the rear-side heater 4 are disposed so as to face each other in the axial direction of the rotating shaft 21. The heat station 6 is disposed outside the heaters 5 and 4 in the radial direction of the rotating shaft 21. The front-side heater 5 and the rear-side heater 4 are moved by a radial direction movement mechanism 16 through the heat station 6 in the radial direction of the rotating shaft 21 and are also moved by an axial direction movement mechanism 15 through the radial direction movement mechanism 16 in the axial direction of the rotating shaft 21. The axial direction movement mechanism 15 extends so as to couple the base 11 and the frame 12.

For example, a displacement meter (not shown) is attached to one of the front-side heater 5 and the rear-side heater 4. The displacement meter measures a distance to the transform target portion 92 of the plate 9. The front-side heater 5 and the rear-side heater 4 are moved in the axial direction and radial direction of the rotating shaft 21 such that a measured value of the displacement meter becomes constant.

The relative positions of the front-side heater 5, the rear-side heater 4, and the processing tool 8 are not especially limited as long as they are located on substantially the same circumference around the center axis 20 of the rotating shaft 21. For example, the front-side heater 5 and the rear-side heater 4 may be separated from the processing tool 8 in a circumferential direction of the rotating shaft 21 by 180°.

Next, configurations of the front-side heater 5 and the rear-side heater 4 will be explained in detail in reference to FIGS. 2 to 5.

The heat station 6 to which the front-side heater 5 and the rear-side heater 4 are coupled includes a box-shaped main body 60 and a pair of connection boxes 61 and 62 fixed to a side surface of the main body 60, the side surface facing the rotating shaft 21. An AC power supply circuit is formed inside the main body 60. The connection boxes 61 and 62 are constituted by electrically-conductive members and are provided adjacent to each other with an insulating plate 72 interposed therebetween. The connection boxes 61 and 62 are electrically connected to the power supply circuit provided in the main body 60. In the present embodiment, each of the connection boxes 61 and 62 extends in the vertical direction so as to be a crosslink between the front-side heater 5 and the rear-side heater 4.

The connection boxes 61 and 62 are electrically connected to each other through a below-described electric conducting pipe 51 of the front-side heater 5 and a below-described electric conducting pipe 41 of the rear-side heater 4. To be specific, an alternating current flows from one of the connection boxes 61 and 62 to the other through the electric conducting pipes 51 and 41. A frequency of the alternating current is not especially limited but is desirably a high frequency of 5 k to 400 kHz. To be specific, the induction heating performed by the front-side heater 5 and the rear-side heater 4 is desirably high frequency induction heating.

The connection boxes 61 and 62 are provided with cooling liquid ports 63 and 64, respectively. A cooling liquid is supplied to one of the connection boxes 61 and 62 through the cooling liquid port (63 or 64) and circulates through the electric conducting pipes 51 and 41. After that, the cooling liquid is discharged from an inside of the other of the connection boxes 61 and 62 through the cooling liquid port (64 or 63). By this circulation of the cooling liquid through the electric conducting pipes 51 and 41, a large current (such as 1,000 to 4,000 A) can flow through the electric conducting pipes 51 and 41.

The front-side heater 5 includes: the electric conducting pipe 51 in which the cooling liquid flows; and a supporting plate 50. A cross-sectional shape of the electric conducting pipe 51 is a square shape in the present embodiment but may be any other shape (such as a circular shape). The supporting plate 50 is made of, for example, a heat-resistant material (such as a ceramic fiber-based material) and supports the electric conducting pipe 51 through an insulating member, not shown. The supporting plate 50 is fixed to the main body 60 of the heat station 6 through an insulating member, not shown. It should be noted that the supporting plate 50 may be made of insulating resin. In this case, the supporting plate 50 may directly support the electric conducting pipe 51 and may be directly fixed to the main body 60 of the heat station 6.

The electric conducting pipe 51 includes a coil portion 54 and a pair of lead portions 52 and 53. The coil portion 54 extends in the circumferential direction of the rotating shaft 21 and has a doubled circular-arc shape facing the plate 9. The lead portions 52 and 53 extend from the coil portion 54 outward in the radial direction of the rotating shaft 21. The lead portions 52 and 53 are parallel to each other on a plane (in the present embodiment, a horizontal plane) orthogonal to the center axis 20 of the rotating shaft 21 and extend from substantially a middle of the coil portion 54. To be specific, the coil portion 54 includes one inner circular-arc portion 55 and two outer circular-arc portions 56 spreading at both sides of the lead portions 52 and 53. The inner circular-arc portion 55 and the outer circular-arc portions 56 are spaced apart from each other in the radial direction of the rotating shaft 21. An opening angle (angle between both end portions) of the coil portion 54 is, for example, 60° to 120°.

Figure 4:
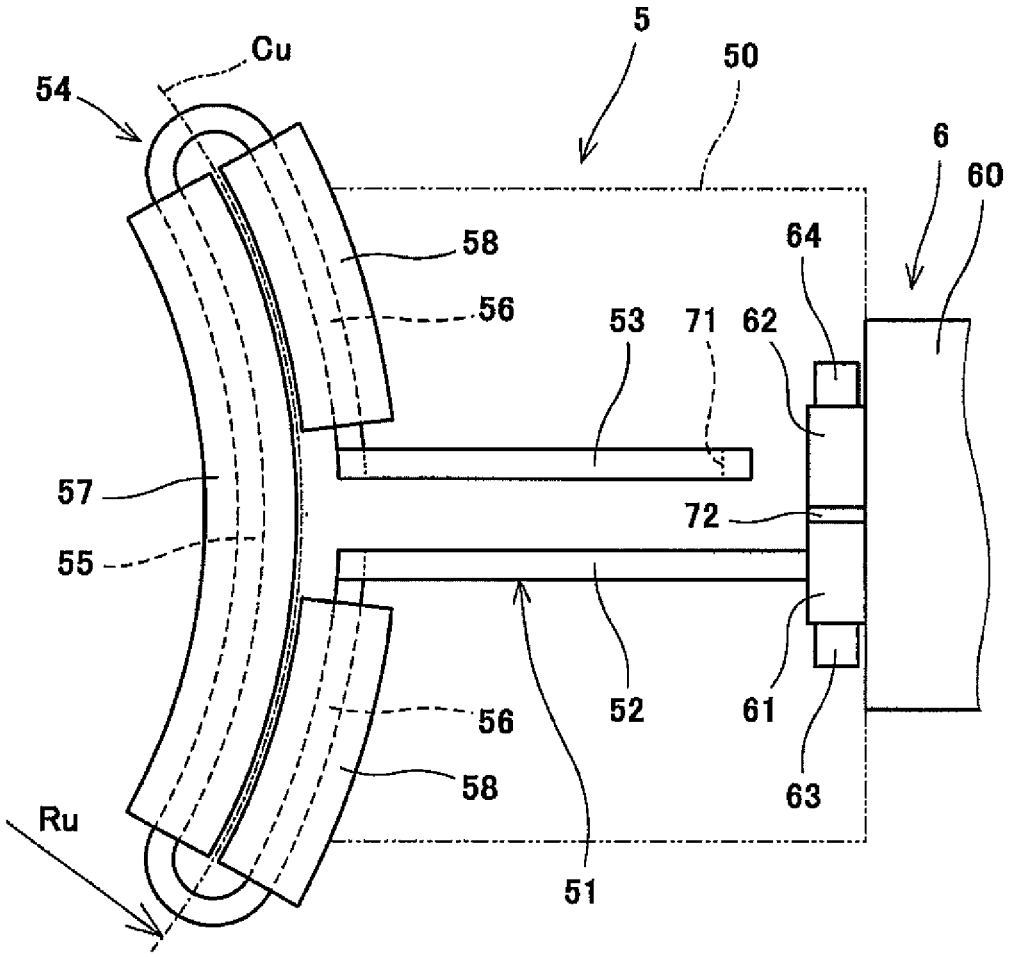
FIG. 4 is a plan view showing the front-side heater when viewed from a position indicated by line IV-IV of FIG. 2.

The lead portion 52 (located at a left side when viewed in a direction from the heat station 6 toward the rotating shaft 21 in FIG. 4) is in connection with the connection box 61, and an inside of the lead portion 52 communicates with an inside of the connection box 61. The lead portion 53 (located at a right side when viewed in the direction from the heat station 6 toward the rotating shaft 21) is in connection with a relay pipe 71.

The front-side heater 5 includes one first core 57 and two second cores 58. The first core 57 covers the inner circular-arc portion 55 of the coil portion 54 from an opposite side of the plate 9. The second cores 58 cover the outer circular-arc portions 56 from the opposite side of the plate 9. The first core 57 is intended to collect magnetic flux generated around the inner circular-arc portion 55, and the second cores 58 are intended to collect magnetic flux generated around the outer circular-arc portions 56. A slight gap is secured between the first core 57 and each of the second cores 58. The first core 57 and the second cores 58 are supported by the supporting plate 50 through an insulating member, not shown. The first core 57 and the second cores 58 are made of resin in which magnetic metal powder is dispersed. Or, the first core 57 and the second cores 58 may be made of ferrite, silicon steel, or the like.

Each of the lead portions 52 and 53 is retreated farther away from the plate 9 than the coil portion 54 at its end portion adjacent to the coil portion 54. In other words, a step is formed between the coil portion 54 and a portion, which is parallel to the radial direction of the rotating shaft 21, of each lead portion 52, 53. In the present embodiment, each of the lead portions 52 and 53 is retreated in the axial direction of the rotating shaft 21 by a thickness of a groove bottom (portion between the circular-arc portion (55 or 56) and the supporting plate 50) of the cores 57 and 58. To be specific, the end portions, adjacent to the coil portion 54, of the lead portions 52 and 53 extend upward from middle-side end portions of the outer circular-arc portions 56 and are then bent at 90° toward the horizontal direction.

It should be noted that how the lead portions 52 and 53 are retreated is not limited to this. For example, each of the end portions, adjacent to the coil portion 54, of the lead portions 52 and 53 may extend obliquely upward from the middle-side end portion of the outer circular-arc portion 56 and be then bent toward the horizontal direction.

The rear-side heater 4 includes: the electric conducting pipe 41 in which the cooling liquid flows; and a supporting plate 40. A cross-sectional shape of the electric conducting pipe 41 is a square shape in the present embodiment but may be any other shape (such as a circular shape). The supporting plate 40 is made of, for example, a heat-resistant material (such as a ceramic fiber-based material) and supports the electric conducting pipe 41 through an insulating member, not shown. The supporting plate 40 is fixed to the main body 60 of the heat station 6 through an insulating member, not shown. It should be noted that the supporting plate 40 may be made of insulating resin. In this case, the supporting plate 40 may directly support the electric conducting pipe 41 and may be directly fixed to the main body 60 of the heat station 6.

The electric conducting pipe 41 includes a coil portion 44 and a pair of lead portions 42 and 43. The coil portion 44 extends in the circumferential direction of the rotating shaft 21 and has a doubled circular-arc shape facing the plate 9. The lead portions 42 and 43 extend from the coil portion 44 outward in the radial direction of the rotating shaft 21. The lead portions 42 and 43 are parallel to each other on a plane (in the present embodiment, a horizontal plane) orthogonal to the center axis 20 of the rotating shaft 21 and extend from substantially a middle of the coil portion 44. To be specific, the coil portion 44 includes one inner circular-arc portion 45 and two outer circular-arc portions 46 spreading at both sides of the lead portions 42 and 43. The inner circular-arc portion 45 and the outer circular-arc portions 46 are spaced apart from each other in the radial direction of the rotating shaft 21. An opening angle (angle between both end portions) of the coil portion 44 is, for example, 60° to 120°.

Figure 5:
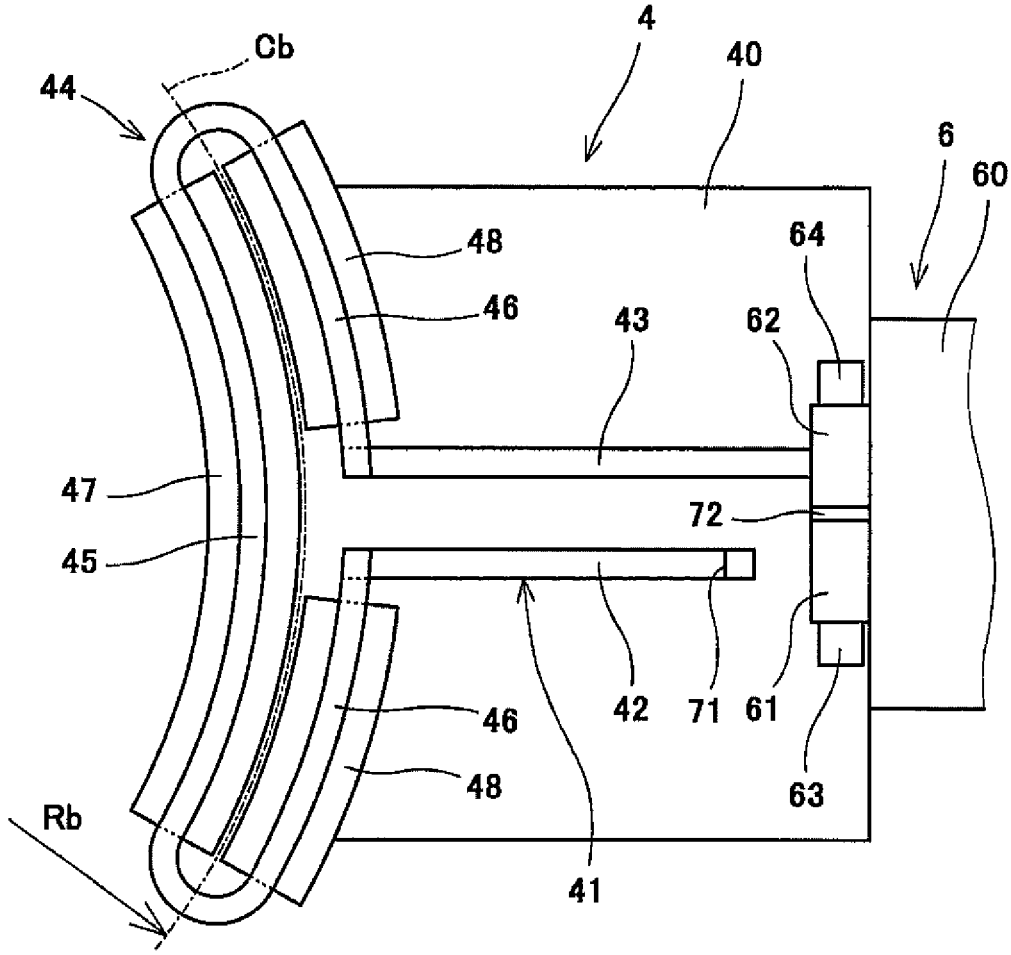
FIG. 5 is a plan view showing the rear-side heater when viewed from a position indicated by line V-V of FIG. 2.

The lead portion 42 (located at a right side when viewed in a direction from the heat station 6 toward the rotating shaft 21 in FIG. 5) is in connection with the connection box 62, and an inside of the lead portion 42 communicates with an inside of the connection box 62. The lead portion 43 (located at a left side when viewed in the direction from the heat station 6 toward the rotating shaft 21) is in connection with the relay pipe 71.

The rear-side heater 4 includes one first core 47 and two second cores 48. The first core 47 covers the inner circular-arc portion 45 of the coil portion 44 from the opposite side of the plate 9. The second cores 48 cover the outer circular-arc portions 46 from the opposite side of the plate 9. The first core 47 is intended to collect magnetic flux generated around the inner circular-arc portion 45, and the second cores 48 are intended to collect magnetic flux generated around the outer circular-arc portions 46. A slight gap is secured between the first core 47 and each of the second cores 48. The first core 47 and the second cores 48 are supported by the supporting plate 40 through an insulating member, not shown. The first core 47 and the second cores 48 are made of resin in which magnetic metal powder is dispersed. Or, the first core 47 and the second cores 48 may be made of ferrite, silicon steel, or the like.

Each of the lead portions 42 and 43 is retreated farther away from the plate 9 than the coil portion 44 at its end portion adjacent to the coil portion 44. In other words, a step is formed between the coil portion 44 and a portion, which is parallel to the radial direction of the rotating shaft 21, of each lead portion 42, 43. In the present embodiment, each of the lead portions 42 and 43 is retreated in the axial direction of the rotating shaft 21 by a thickness of a groove bottom (portion between the circular-arc portion (45 or 46) and the supporting plate 40) of the cores 47 and 48. To be specific, the end portions, adjacent to the coil portion 44, of the lead portions 42 and 43 extend downward from middle-side end portions of the outer circular-arc portions 46 and are then bent at 90° toward the horizontal direction.

It should be noted that how the lead portions 42 and 43 are retreated is not limited to this. For example, each of the end portions, adjacent to the coil portion 44, of the lead portions 42 and 43 may extend obliquely downward from the middle-side end portion of the outer circular-arc portion 46 and be then bent toward the horizontal direction.

The right-side lead portion 53 of the front-side heater 5 and the left-side lead portion 42 of the rear-side heater 4 are connected to each other by the relay pipe 71 that is bent in a crank shape. In other words, the connected lead portions of the front-side and rear-side heaters 5 and 4 are not located at the same side but are located at different sides. With this, a direction in which the cooling liquid and the current flow in the coil portion 54 of the front-side heater 5 and a direction in which the cooling liquid and the current flow in the coil portion 44 of the rear-side heater 4 become the same as each other. It should be noted that the connected lead portions of the front-side and rear-side heaters 5 and 4 may be located at the same side.

As explained above, in the spinning forming device 1A of the present embodiment, each of the lead portions 42 and 43 of the rear-side heater 4 is retreated farther away from the plate 9 than the coil portion 44 at its end portion adjacent to the coil portion 44, and each of the lead portions 52 and 53 of the front-side heater 5 is retreated farther away from the plate 9 than the coil portion 54 at its end portion adjacent to the coil portion 54. Therefore, even if the peripheral edge portion 93 of the plate 1 deforms so as to hang downward or so as to warp upward, the peripheral edge portion 93 of the plate 9 can be prevented from contacting the lead portions 42, 43, 52, and 53.

If whether the deformation of the peripheral edge portion 93 of the plate 9 is the hand-downward deformation or the warp-upward deformation is assumable beforehand, the lead portions of only one of the rear-side heater 4 and the front-side heater 5 may be retreated. In this case, the lead portions (42, 43 or 52, 53) of the other of the rear-side heater 4 and the front-side heater 5 may extend linearly from the coil portion (44 or 54) in the radial direction of the rotating shaft 21. To be specific, a step does not have to be formed between the coil portion and the lead portion in the other of the rear-side heater 4 and the front-side heater 5.

Figure 2:
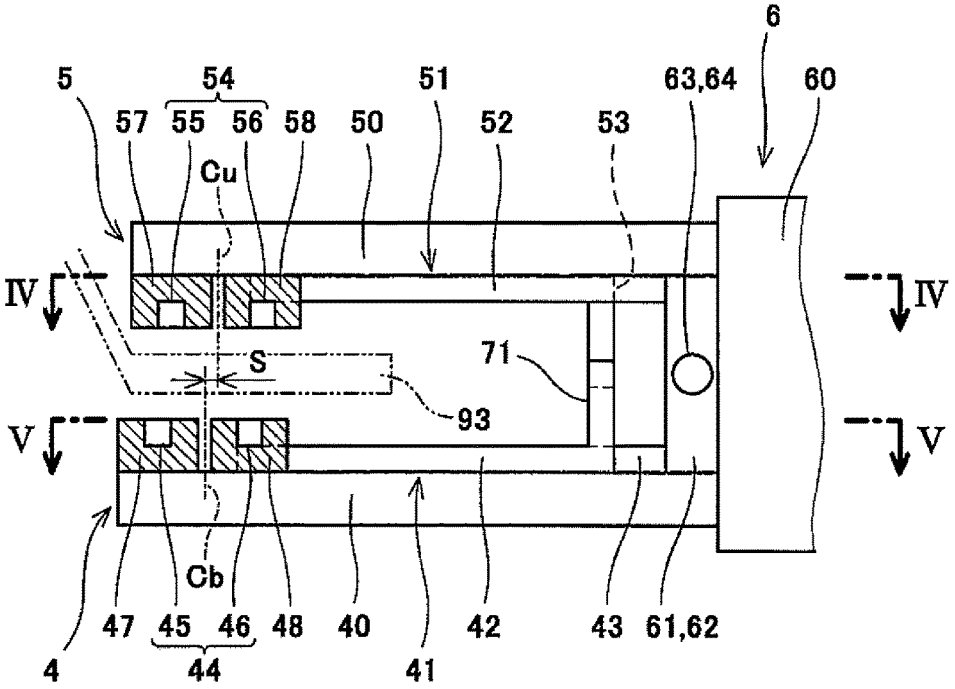
FIG. 2 is a cross-sectional side view showing a front-side heater and a rear-side heater in Embodiment 1.
Figure 3:
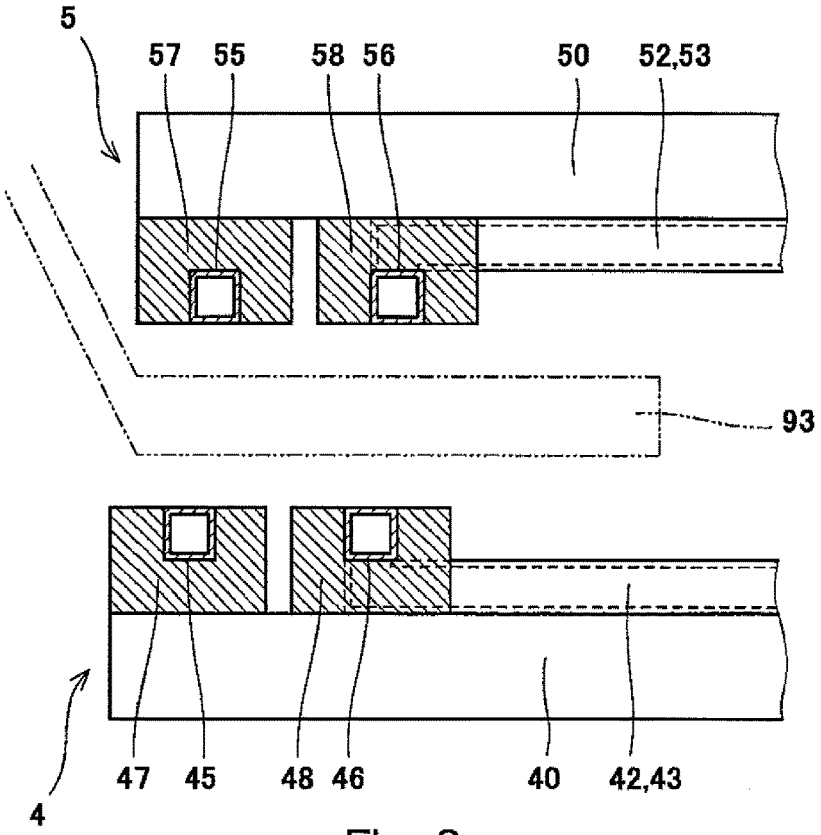
FIG. 3 is an enlarged view showing a part of FIG. 2.

In the present embodiment, as shown in FIG. 2, the position of a center Cu of the coil portion 54 of the front-side heater 5 is displaced from the position of a center Cb of the coil portion 44 of the rear-side heater 4 outward in the radial direction of the rotating shaft 21 by a predetermined distance S. It is desirable that a relationship among the predetermined distance S, a curvature radius Ru (see FIG. 4) of the center Cu of the coil portion 54 of the front-side heater 5, and a curvature radius Rb (see FIG. 5) of the center Cb of the coil portion 44 of the rear-side heater 4 satisfy Formula 1 below.

$$0.5S \leq Ru - Rb \leq 1.5S \qquad \text{Formula 1}$$

The processing tool 8 presses the transform target portion 92 of the plate 9 in the axial direction of the rotating shaft 21 while being moved outward in the radial direction of the rotating shaft 21. Therefore, a diameter of a conical portion (so-called immediately-after-forming portion) shaped immediately inside the transform target portion 92 gradually increases. On the other hand, a radius of the coil portion 54 of the front-side heater 5 that heats the transform target portion 92 is constant. Therefore, as shown in FIG. 16, if the radius of the coil portion 54 is set to be equal to a radius of the forming start position Ps, both end portions of the coil portion 54 are located at a radially inner side of the forming finish position Pf after the forming finish in a plan view, so that the immediately-after-forming portion of the plate 9 may contact the first core 57. However, if Formula 1 shown above is satisfied, such contact between the immediately-after-forming portion of the plate 9 and the first core 57 of the front-side heater 5 can be suppressed. It should be noted that the radius of the coil portion 54 when Formula 1 shown above is satisfied may be equal to a radius of the forming finish position Pf. Further, the curvature radius Ru and the curvature radius Rb may be equal to each other depending on the radius of the forming start position Ps and the radius of the forming finish position Pf.

Modified Example

In Embodiment 1, each of the lead portions 42 and 43 of the rear-side heater 4, at its end portion adjacent to the coil portion 44, is retreated away from the plate 9 by one step, and each of the lead portions 52 and 53 of the front-side heater 5, at its end portion adjacent to the coil portion 54, is retreated away from the plate 9 by one step. However, each of the lead portions of at least one of the rear-side heater 4 and the front-side heater 5, at its end portion adjacent to the coil portion, may be retreated away from the plate 9 by at least two steps. According to this configuration, the contact between the peripheral edge portion 93 of the plate 9 and the lead portion can be more effectively prevented.

Figure 6:
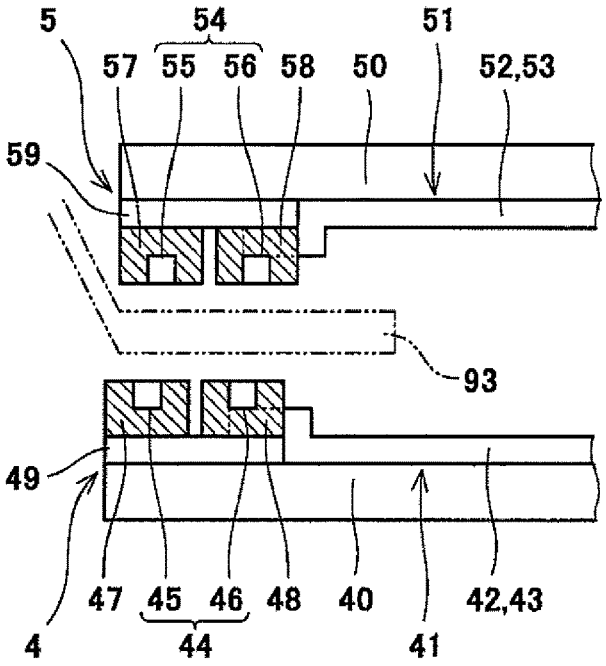
FIG. 6 is a cross-sectional side view showing the front-side heater and the rear-side heater in Modified Example of Embodiment 1.

For example, as shown in FIG. 6, a spacer 59 is inserted between the supporting plate 50 and a group of the first core 57 and second cores 58 of the front-side heater 5. A first step out of the two steps is the same as the step in Embodiment 1, and a second step is formed such that the lead portion (52, 53) is retreated by a thickness of the spacer 59. Similarly, a spacer 49 is inserted between the supporting plate 40 and a group of the first core 47 and second cores 48 of the rear-side heater 4. A first step out of the two steps is the same as the step in Embodiment 1, and a second step is formed such that the lead portion (42, 43) is retreated by a thickness of the spacer 49.

Each of the lead portions 52 and 53 of the front-side heater 5 may be retreated by one step, and each of the lead portions 42 and 43 of the rear-side heater 4 may be retreated by two steps. Similarly, each of the lead portions 42 and 43 of the rear-side heater 4 may be retreated by one step, and each of the lead portions 52 and 53 of the front-side heater 5 may be retreated by two steps.

Figure 7:
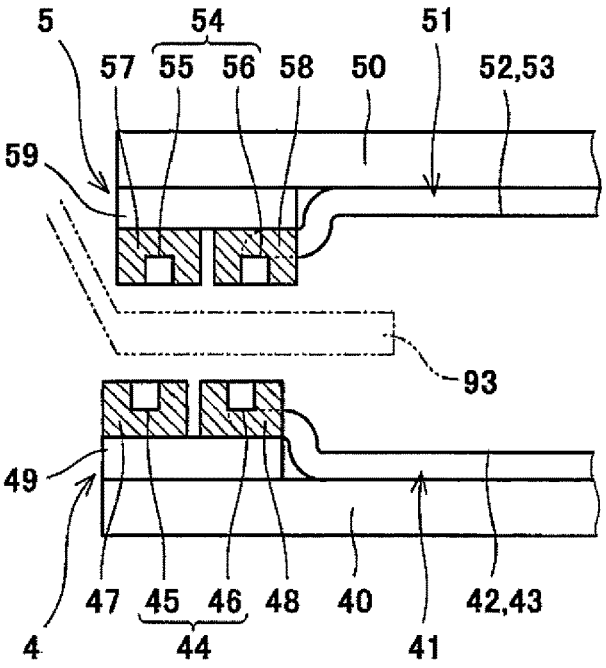
FIG. 7 is a cross-sectional side view showing the front-side heater and the rear-side heater in another Modified Example of Embodiment 1.

Further, in each of a case where each of the lead portions (42, 43 and/or 52, 53) is retreated by only one step and a case where each of the lead portions (42, 43 and/or 52, 53) is retreated by at least two steps, the lead portion may be retreated so as to smoothly curve as shown in FIG. 7. According to this configuration, the cooling liquid can smoothly flow through the entire electric conducting pipe (41 and/or 51), and air bubbles can be prevented from being accumulated in the electric conducting pipe. Therefore, an excellent cooling performance can be obtained, and the electric conducting pipe can be prevented from melting.

Figure 8:
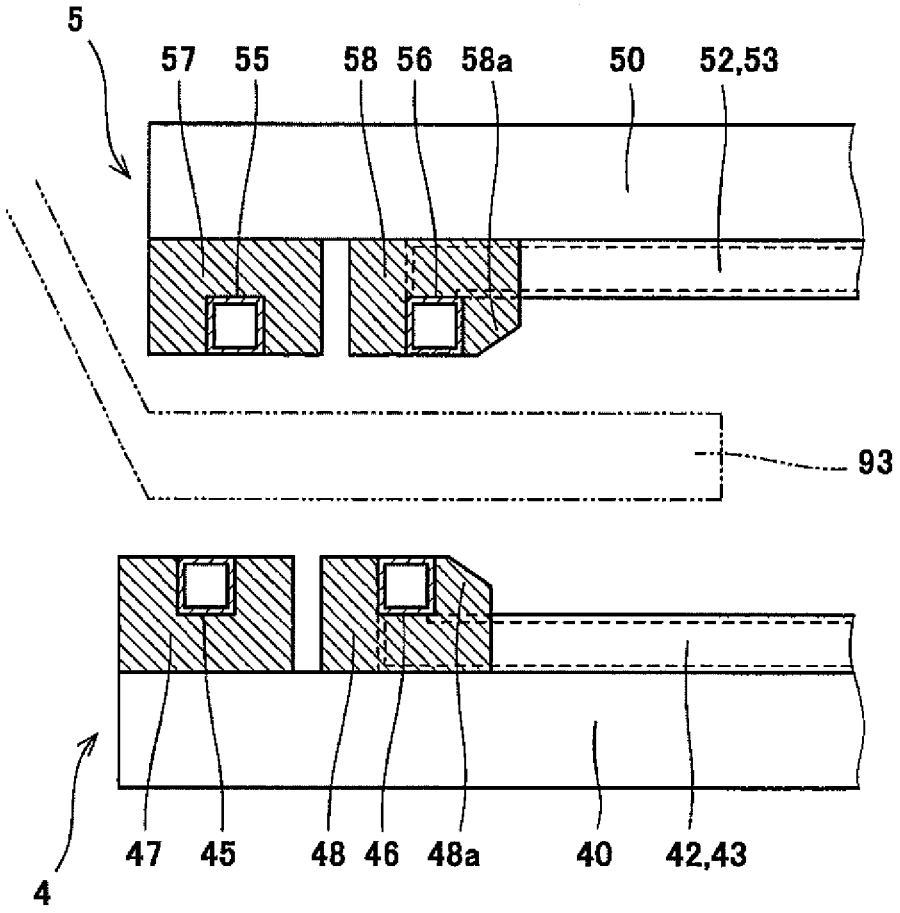
FIG. 8 is an enlarged cross-sectional side view showing the front-side heater and the rear-side heater in yet another Modified Example of Embodiment 1.
Figure 9:
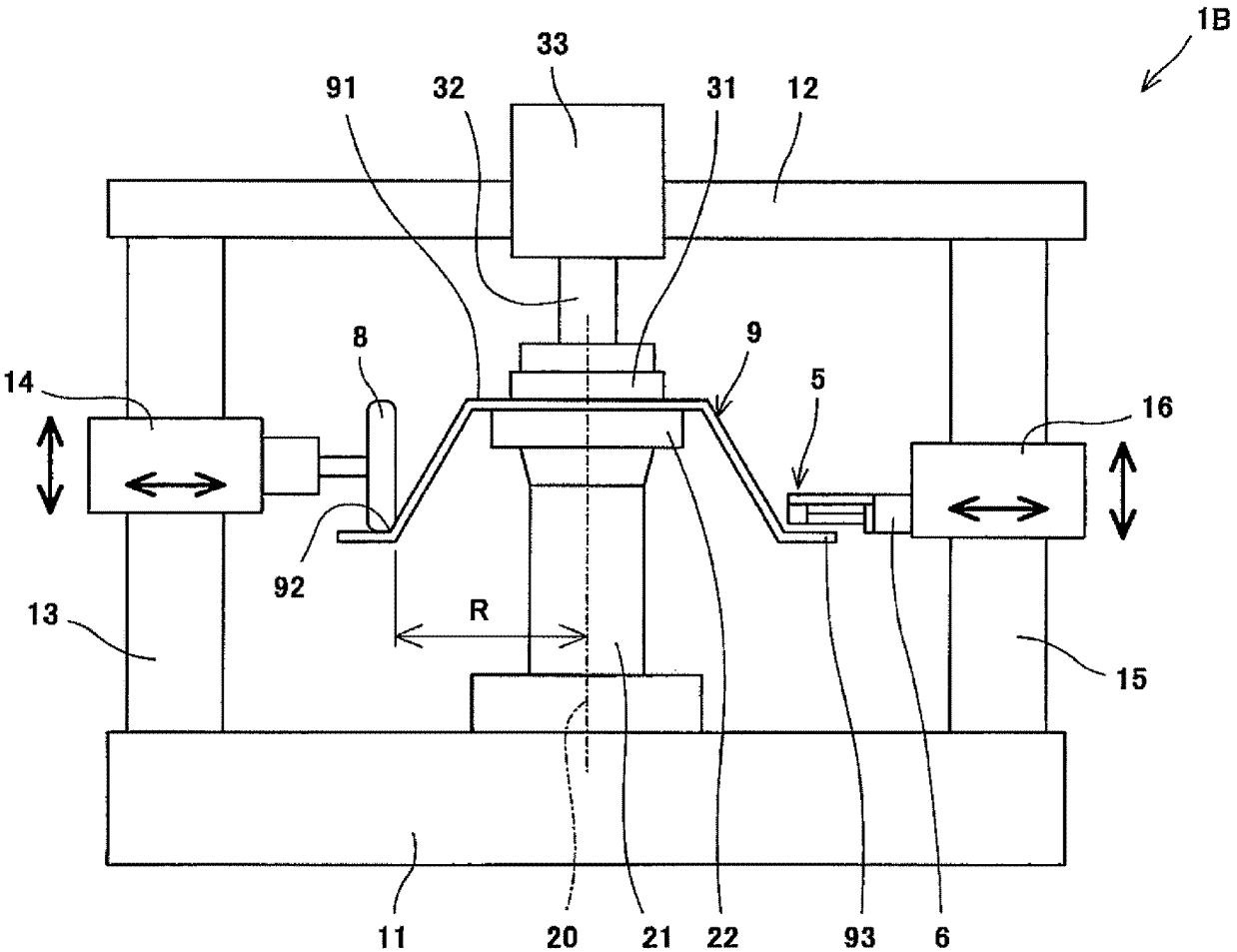
FIG. 9 is a schematic configuration diagram showing the spinning forming device according to Embodiment 2 of the present invention.
Figure 10:
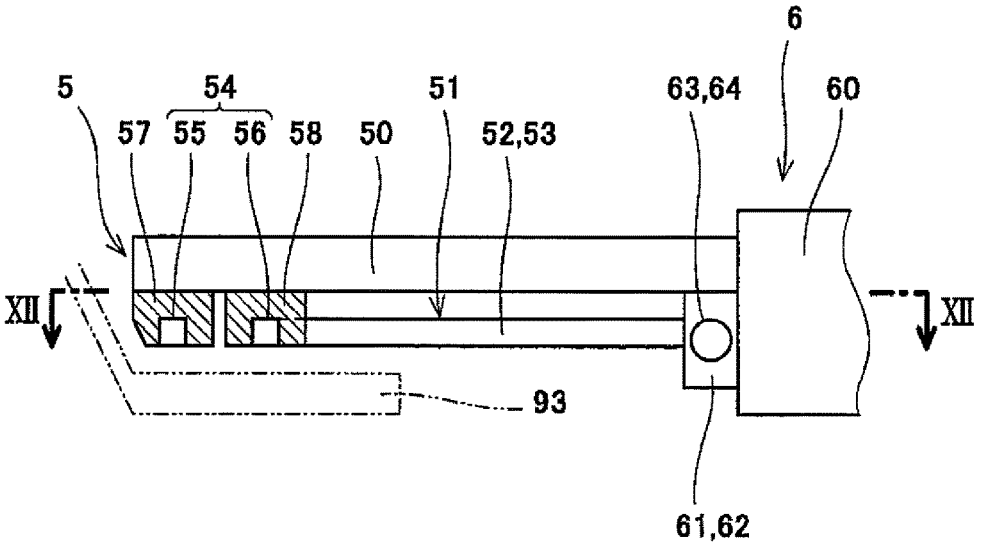
FIG. 10 is a cross-sectional side view showing the front-side heater in Embodiment 2.

In at least one of the front-side heater 5 and the rear-side heater 4, as shown in FIG. 8, at least a part of an outer wall portion (58*a*, 48*a*) of the second core (58, 48) may have a shape that tapers toward a tip end of the outer wall portion, the outer wall portion being located at a radially outer side of the outer circular-arc portion (56, 46). For example, the outer wall portion may have such a shape that a radially outer side tip end corner portion thereof is obliquely cut out. In other words, an inclined surface may be formed at the outer wall portion such that a part of a flat tip end surface that is flush with a surface, facing the plate 9, of the outer circular-arc portion remains or such that the tip end surface does not remain at all. According to this configuration, the contact between the peripheral edge portion 93 of the plate 9 and the second core can also be prevented.

The spinning forming device 1A is not necessarily required to include both of the front-side heater 5 and the rear-side heater 4 and may include any one of the front-side heater 5 and the rear-side heater 4. When the spinning forming device 1A includes at least the rear-side heater 4, the rear-side heater 4 can be located immediately close to the transform target portion 92 of the plate 9 regardless of the shape of the plate 9 during processing. With this, the transform target portion 92 can be appropriately heated.

Embodiment 2

Next, a spinning forming device 1B according to Embodiment 2 of the present invention will be explained in reference to FIGS. 9 to 12. In the present embodiment and Embodiment 3 described later, the same reference signs are used for the same components as in Embodiment 1, and a repetition of the same explanation is avoided.

In the present embodiment, the spinning forming device 1B includes only the front-side heater 5. However, needless to say, the spinning forming device 1B may further include the rear-side heater 4 as with Embodiment 1. In this case, both the front-side heater 5 and the rear-side heater 4 may be coupled to the common heat station 6, or the front-side heater 5 and the rear-side heater 4 may be coupled to heat stations 6A and 6B (see FIG. 15), respectively, as with Embodiment 3 described later.

In the present embodiment, the lead portions 52 and 53 of the electric conducting pipe 51 extend from the coil portion 54 linearly in the radial direction of the rotating shaft 21 and are connected to the connection boxes 61 and 62, respectively.

Figure 11:
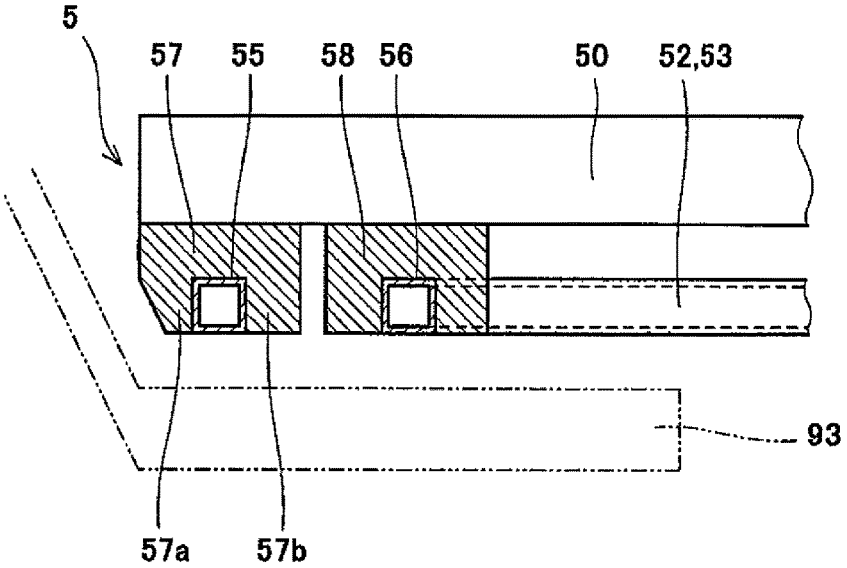
FIG. 11 is an enlarged view showing a part of FIG. 10.
Figure 12:
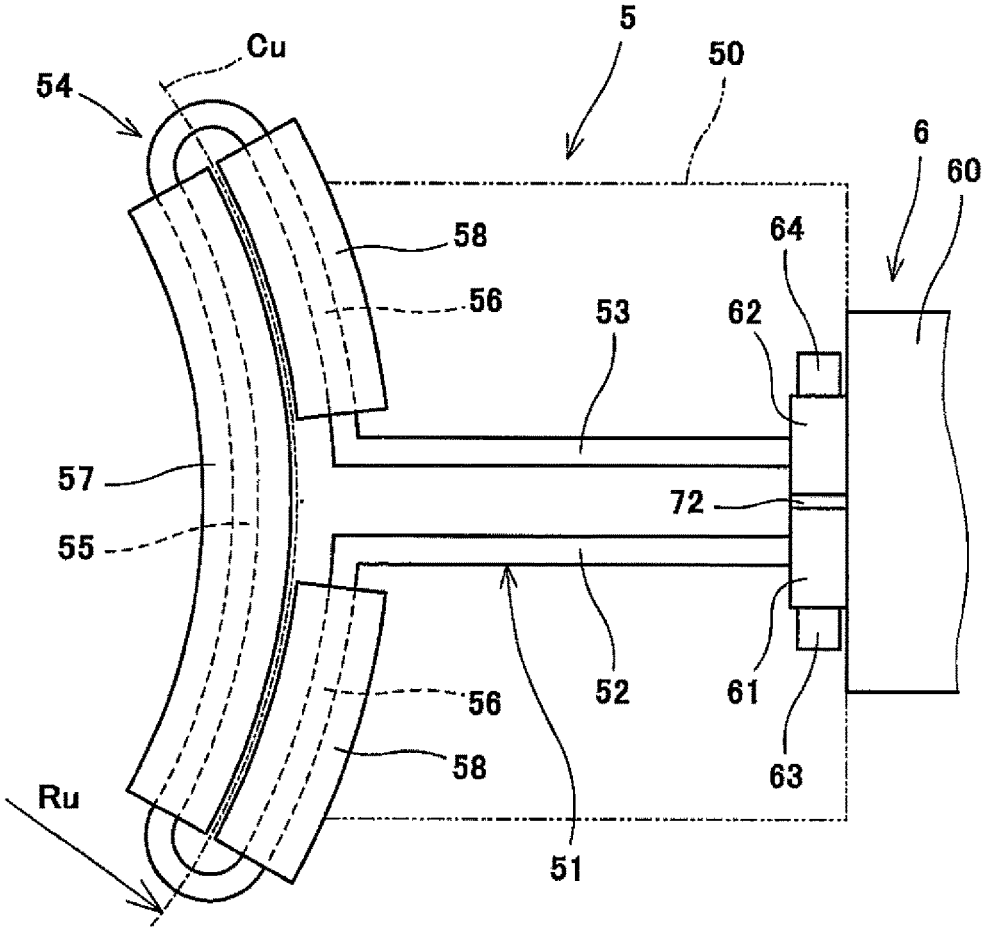
FIG. 12 is a plan view showing the front-side heater when viewed from a position indicated by line XII-XII of FIG. 10.

As shown in FIG. 11, the first core 57 covering the inner circular-arc portion 55 of the coil portion 54 from the opposite side of the plate 9 includes: an inner wall portion 57*a* located at a radially inner side of the inner circular-arc portion 55; and an outer wall portion 57*b* located at a radially outer side of the inner circular-arc portion 55. The outer wall portion 57*b* has a constant width (size in the radial direction of the rotating shaft 21) from a base portion of the outer wall portion 57*b* to a tip end of the outer wall portion 57*b*. On the other hand, at least a part of the inner wall portion 57*a* has a shape that tapers toward a tip end of the inner wall portion 57*a*.

In the present embodiment, the inner wall portion 57*a* has such a shape that a radially inner side tip end corner portion thereof is obliquely cut out. In other words, an inclined surface is formed at the inner wall portion 57*a* such that a part of a flat tip end surface that is flush with a surface, facing the plate 9, of the inner circular-arc portion 55 remains. It should be noted that the inclined surface may be formed at the inner wall portion 57*a* such that the tip end surface of the inner wall portion 57*a* does not remain at all.

The processing tool 8 presses the transform target portion 92 of the plate 9 in the axial direction of the rotating shaft 21 while being moved outward in the radial direction of the rotating shaft 21. Therefore, the diameter of the conical portion (so-called immediately-after-forming portion) shaped immediately inside the transform target portion 92 gradually increases. On the other hand, the radius of the coil portion 54 of the front-side heater 5 that heats the transform target portion 92 is constant. Therefore, as shown in FIG. 16, if the radius of the coil portion 54 is set to be equal to the radius of the forming start position Ps, both end portions of the coil portion 54 are located at a radially inner side of the forming finish position Pf after the forming finish in a plan view, so that the immediately-after-forming portion of the plate 9 may contact the first core 57.

On the other hand, as in the spinning forming device 1B of the present embodiment, when the inner wall portion 57*a* of the first core 57 has a shape that tapers toward a tip end of the inner wall portion 57*a*, the contact between the immediately-after-forming portion of the plate 9 and the first core 57 of the front-side heater 5 can be suppressed. It should be noted that the radius of the coil portion 54 may be equal to the radius of the forming finish position Pf.

Modified Example

Figure 14:
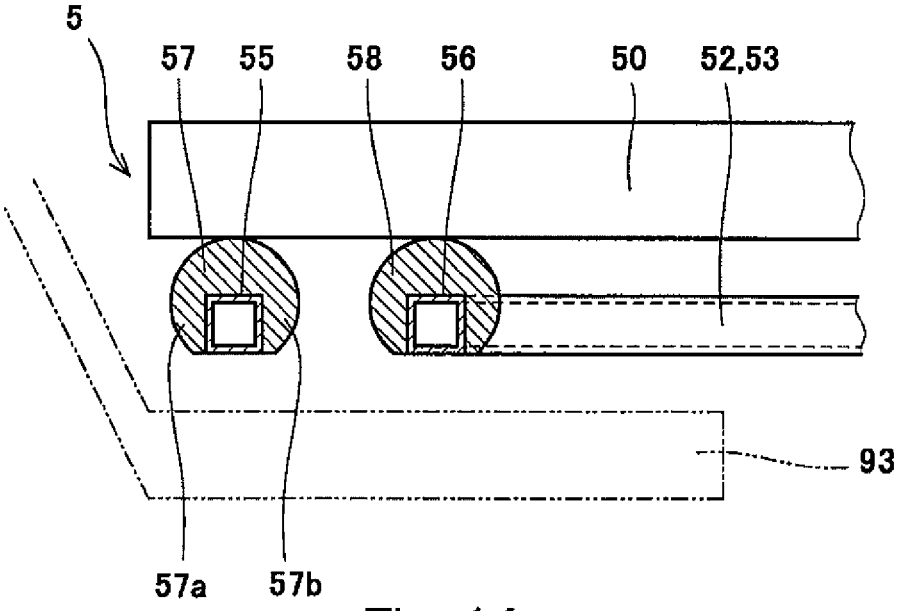
FIG. 14 is an enlarged cross-sectional side view showing the front-side heater in another Modified Example of Embodiment 2.

The first core 57 may have any shape as long as the shape of the inner wall portion 57*a* tapers toward the tip end. For example, as shown in FIG. 14, a contour of a cross-sectional shape of the first core 57 may be such a shape that a part of a circle is linearly cut out (for example, a portion corresponding to one tenth to one third of a diameter of the circle is linearly cut out).

Figure 13:
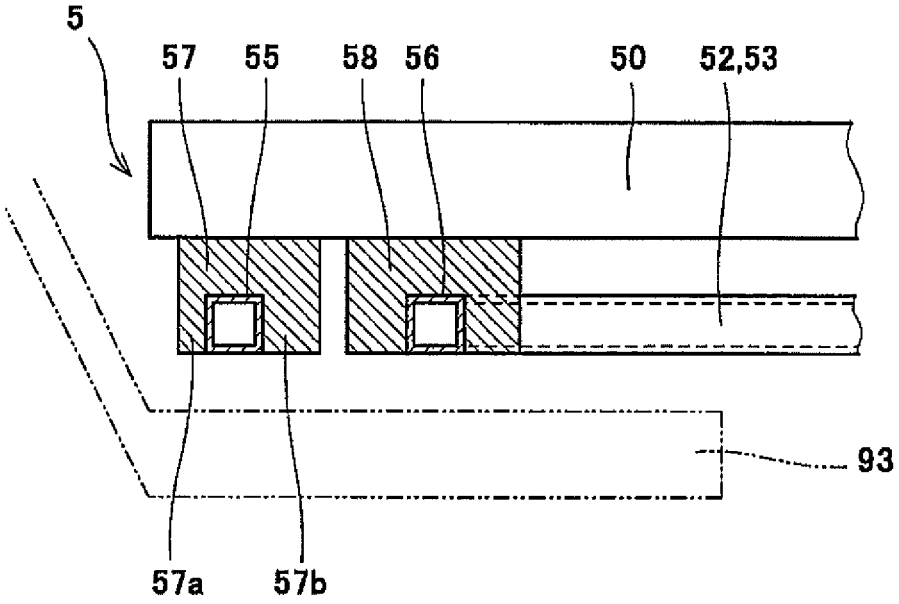
FIG. 13 is an enlarged cross-sectional side view showing the front-side heater in Modified Example of Embodiment 2.

Or, the shape of the inner wall portion 57*a* is not necessarily required to taper toward the tip end. For example, as shown in FIG. 13, the inner wall portion 57*a* may be thinner than the outer wall portion 57*b*. Even in this configuration, the same effects as in Embodiment 2 can be obtained.

When the spinning forming device 1B further includes the rear-side heater 4, as with Embodiment 1, the position of the center Cu of the coil portion 54 of the front-side heater 5 may be displaced from the position of the center Cb of the coil portion 44 of the rear-side heater 4 outward in the radial direction of the rotating shaft 21 by the predetermined distance S. It is desirable that the relationship among the predetermined distance S, the curvature radius Ru (see FIG. 4) of the center Cu of the coil portion 54 of the front-side heater 5, and the curvature radius Rb (see FIG. 5) of the center Cb of the coil portion 44 of the rear-side heater 4 satisfy Formula 1 below.

$$0.5S \leq Ru - Rb \leq 1.5S \qquad \text{Formula 1}$$

According to this configuration, the contact between the immediately-after-forming portion of the plate 9 and the first core 57 of the front-side heater 5 can be more effectively suppressed.

Embodiment 3

Figure 15:
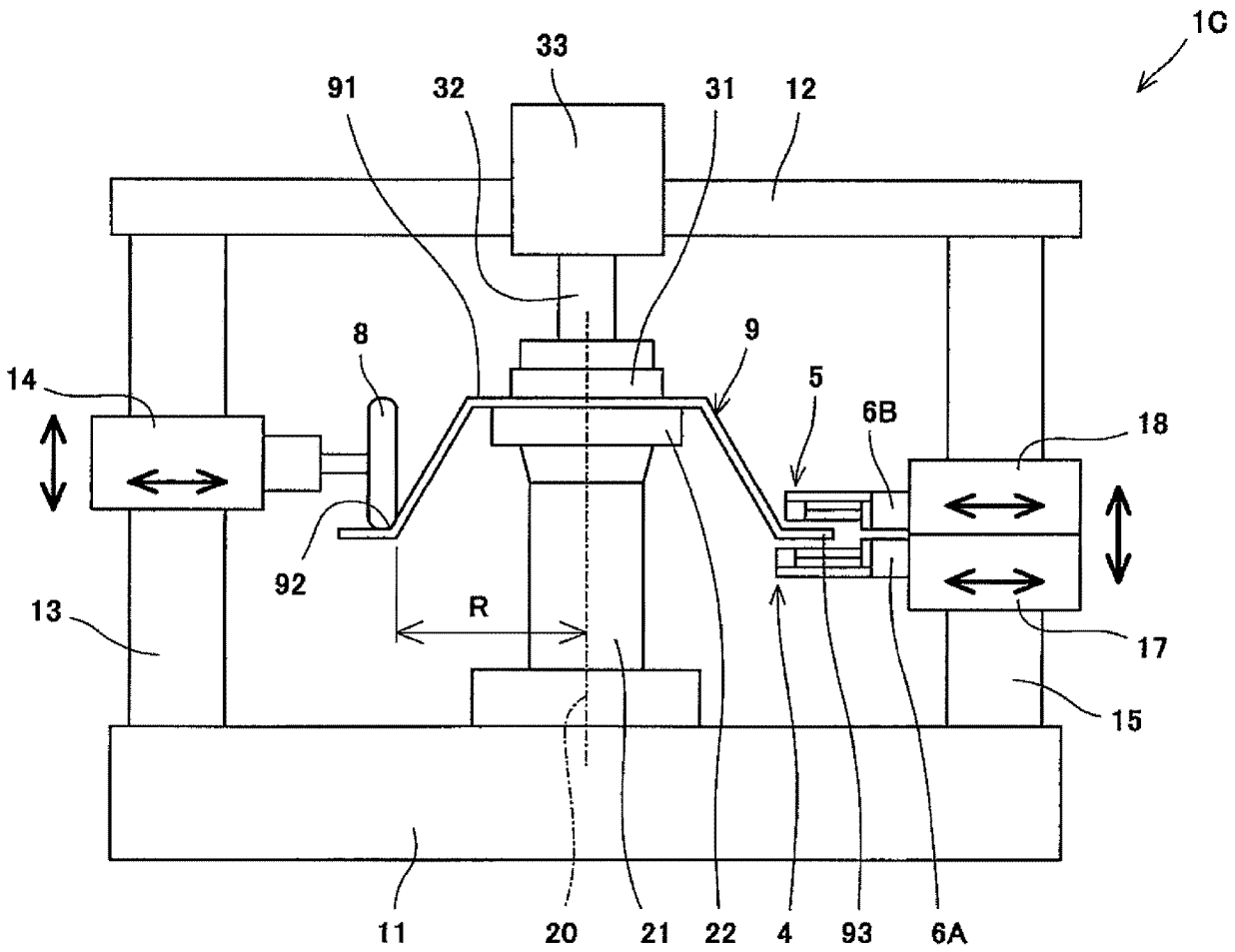
FIG. 15 is a schematic configuration diagram showing the spinning forming device according to Embodiment 3 of the present invention.

Next, a spinning forming device 1C according to Embodiment 3 of the present invention will be explained in reference to FIG. 15. In the present embodiment, the front-side heater 5 and the rear-side heater 4 are configured to be individually movable in the radial direction.

Specifically, in the present embodiment, the front-side heater 5 and the rear-side heater 4 are coupled to the heat stations 6A and 6B, respectively. The rear-side heater 4 is moved by a first radial direction movement mechanism 17 through the heat station 6A in the radial direction of the rotating shaft 21. The front-side heater 5 is moved by a second radial direction movement mechanism 18 through the heat station 6B in the radial direction of the rotating shaft 21. The front-side heater 5 and the rear-side heater 4 are moved by the axial direction movement mechanism 15 through the radial direction movement mechanisms 17 and 18 in the axial direction of the rotating shaft 21.

The second radial direction movement mechanism 18 moves the front-side heater 5 in the radial direction of the rotating shaft 21 at a speed higher than a speed at which the first radial direction movement mechanism 17 moves the rear-side heater 4 in the radial direction of the rotating shaft 21. To be specific, as the forming of the plate 9 proceeds, the front-side heater 5 moves farther away from the center axis 20 of the rotating shaft 21 than the rear-side heater 4.

Each of the heat stations 6A and 6B is the same in configuration as the heat station 6 in Embodiment 1. To be specific, each of the heat stations 6A and 6B includes the main body 60 (see FIG. 2) in which the AC power supply circuit is formed. The independent current and the independent cooling liquid flow through each of the electric conducting pipe 41 of the rear-side heater 4 and the electric conducting pipe 51 of the front-side heater 5.

The processing tool 8 presses the transform target portion 92 of the plate 9 in the axial direction of the rotating shaft 21 while being moved outward in the radial direction of the rotating shaft 21. Therefore, the diameter of the conical portion (so-called immediately-after-forming portion) shaped immediately inside the transform target portion 92 gradually increases. On the other hand, the radius of the coil portion 54 of the front-side heater 5 that heats the transform target portion 92 is constant. Therefore, as shown in FIG. 16, if the radius of the coil portion 54 is set to be equal to the radius of the forming start position Ps, both end portions of the coil portion 54 are located at a radially inner side of the forming finish position Pf after the forming finish in a plan view, so that the immediately-after-forming portion of the plate 9 may contact the first core 57.

On the other hand, as in the spinning forming device 1C of the present embodiment, when the front-side heater 5 moves in the radial direction of the rotating shaft 21 at a speed higher than a speed at which the rear-side heater 4 moves, the contact between the immediately-after-forming portion of the plate 9 and the first core 57 of the front-side heater 5 can be suppressed. It should be noted that the radius of the coil portion 54 may be equal to the radius of the forming finish position Pf.

INDUSTRIAL APPLICABILITY

The present invention is useful when performing spinning forming of plates made of various materials.

REFERENCE SIGNS LIST

1A to 1C spinning forming device
13, 15 axial direction movement mechanism
14, 16 radial direction movement mechanism
17 first radial direction movement mechanism
18 second radial direction movement mechanism
21 rotating shaft
22 receiving jig
4 rear-side heater
5 front-side heater
41, 51 electric conducting pipe
42, 43, 52, 53 lead portion
44, 54 coil portion
45, 55 inner circular-arc portion
46, 56 outer circular-arc portion
47, 57 first core
48, 58 second core
57*a* inner wall portion
57*b*, 48*a* outer wall portion
8 processing tool
9 plate
91 central portion
92 transform target portion

The invention claimed is:

1. A spinning forming device comprising:
a receiving jig supporting a central portion of a plate to be formed;
a rotating shaft to which the receiving jig is attached;
a processing tool that presses a transform target portion of the plate to transform the plate; and
a heater that locally heats the transform target portion by induction heating, wherein:
the heater includes an electric conducting pipe in which a cooling liquid flows;
the electric conducting pipe includes
a coil portion extending in a circumferential direction of the rotating shaft and having a doubled circular-arc shape facing one surface of the plate and
a pair of lead portions extending from the coil portion outward in a radial direction of the rotating shaft; and
each of the pair of lead portions is retreated farther away from the plate in a thickness direction of the plate than the coil portion at an end portion of the lead portion, the end portion being adjacent to the coil portion.

2. The spinning forming device according to claim 1, wherein each of the pair of lead portions is retreated away from the plate by at least two stair-shaped steps.

3. The spinning forming device according to claim 1, wherein the heater is a rear-side heater disposed at an opposite side of the processing tool across the plate.

4. The spinning forming device according to claim 3, wherein:
the rear-side heater includes a first core covering an inner circular-arc portion of the coil portion from an opposite side of the plate and a second core covering an outer circular-arc portion of the coil portion from the opposite side of the plate; and
at least a part of an outer wall portion of the second core has a tapered shape toward a tip end of the outer wall portion, the outer wall portion being located at a radially outer side of the outer circular-arc portion.

5. The spinning forming device according to claim 1, wherein the heater includes:
a rear-side heater disposed at an opposite side of the processing tool across the plate; and
a front-side heater disposed at a same side as the processing tool relative to the plate.

6. A spinning forming device comprising:
a receiving jig supporting a central portion of a plate to be formed;
a rotating shaft to which the receiving jig is attached;
a processing tool that presses a transform target portion of the plate to transform the plate; and
a front-side heater that locally heats the transform target portion by induction heating and is disposed at a same side as the processing tool relative to the plate, wherein:
the front-side heater includes
an electric conducting pipe in which a cooling liquid flows, the electric conducting pipe including a coil portion, the coil portion extending in a circumferential direction of the rotating shaft and having a doubled circular-arc shape facing one surface of the plate,
a first core opposing the one surface and covering an inner circular-arc portion of the coil portion from a side of the coil portion opposite to the one surface of the plate, and
a second core opposing the one surface and covering an outer circular-arc portion of the coil portion from the side of the coil portion opposite to the one surface of the plate; and
at least a part of an inner wall portion of the first core has a shape that tapers toward a tip end of the inner wall portion, the inner wall portion being located at a radially inner side of the inner circular-arc portion, or the inner wall portion of the first core is thinner than an outer wall portion of the first core, the outer wall portion being located at a radially outer side of the inner circular-arc portion.

7. The spinning forming device according to claim 6, further comprising a rear-side heater that locally heats the transform target portion of the plate by the induction heating and is disposed at an opposite side of the processing tool across the plate, wherein the rear-side heater includes an electric conducting pipe in which the cooling liquid flows, the electric conducting pipe including a coil portion, the coil portion extending in the circumferential direction of the rotating shaft and having a doubled circular-arc shape facing the plate.

8. A spinning forming device comprising:

a receiving jig supporting a central portion of a plate to be formed;

a rotating shaft to which the receiving jig is attached;

processing tool that presses a transform target portion of the plate to transform the plate;

a rear-side heater that locally heats the transform target portion by induction heating and is disposed at an opposite side of the processing tool across the plate; and a front-side heater that locally heats the transform target portion by the induction heating and is disposed at a same side as the processing tool relative to the plate, wherein:

each of the rear-side heater and the front-side heater includes an electric conducting pipe in which a cooling liquid flows;

the electric conducting pipe includes a coil portion extending in a circumferential direction of the rotating shaft and having a doubled circular-arc shape facing the plate and a pair of lead portions extending from the coil portion outward in a radial direction of the rotating shaft;

a position of a center of the coil portion of the front-side heater is displaced from a position of a center of the coil portion of the rear-side heater outward in the radial direction of the rotating shaft by a predetermined distance; and a formula "$0.5S \leq Ru - Rb \leq 1.5S$" is satisfied, where S denotes the predetermined distance, Ru denotes a curvature radius of the center of the coil portion of the front-side heater, and Rb denotes a curvature radius of the center of the coil portion of the rear-side heater.

9. A spinning forming device comprising:

a receiving jig supporting a central portion of a plate to be formed;

a rotating shaft to which the receiving jig is attached;

a processing tool that presses a transform target portion of the plate to transform the plate;

a front-side heater that locally heats the transform target portion by induction heating and is disposed at a same side as the processing tool relative to the plate;

a rear-side heater that locally heats the transform target portion by the induction heating and is disposed at an opposite side of the processing tool across the plate;

an axial direction movement mechanism that moves the front-side heater and the rear-side heater in an axial direction of the rotating shaft;

a first radial direction movement mechanism that moves the rear-side heater in a radial direction of the rotating shaft; and a second radial direction movement mechanism that moves the front-side heater in the radial direction of the rotating shaft at a speed higher than a speed at which the rear-side heater moves, wherein each of the front-side heater and the rear-side heater includes an electric conducting pipe in which a cooling liquid flows, the electric conducting pipe including a coil portion, the coil portion extending in a circumferential direction of the rotating shaft and having a doubled circular-arc shape facing the plate, a first core covering an inner circular-arc portion of the coil portion from an opposite side of the plate, and a second core covering an outer circular-arc portion of the coil portion from the opposite side of the plate.

* * * * *